US005393168A

United States Patent [19]

Jarvis

[11] Patent Number: 5,393,168

[45] Date of Patent: Feb. 28, 1995

[54] DEVICE FOR CONNECTING AN ELONGATED HANDLE TO A BULL FLOAT PLATE

[76] Inventor: Jack D. Jarvis, 3204 Periwinkle, Memphis, Tenn. 38127

[21] Appl. No.: 95,582

[22] Filed: Jul. 19, 1993

[51] Int. Cl.[6] ..... E01C 19/44

[52] U.S. Cl. ..... 404/97; 15/235.8

[58] Field of Search ..... 404/96, 97, 118; 15/235.4, 235.8, 143.1, 144.1, 144.2, 145; D8/45

[56] References Cited

U.S. PATENT DOCUMENTS 1,021,557 3/1912 Runner ..... 404/97 X
2,834,199 5/1958 Freeman ..... 15/235.8
3,798,701 3/1974 Irwin et al. ..... 15/235.8
4,702,641 10/1987 Naser et al. ..... 404/118 X

*Primary Examiner*—Ramon S. Britts
*Assistant Examiner*—James A. Lisehora
*Attorney, Agent, or Firm*—Paul M. Denk

[57] ABSTRACT

A device for connecting an elongated handle to a bull float plate having a hollow body formed from four opposed walls, a bracket pivotally connected to the body for attaching the body to the top side of a bull float, a rotatable connector to removably attach an elongated handle on the body opposite the bracket, and a bevel gear assembly within the body cooperatively connecting the connector and bracket and disposed to translate the rotational movement of the handle connector into pivotable movement of the bracket thereby effecting the slight pivotal movement of the bull float and its plate.

6 Claims, 3 Drawing Sheets

DEVICE FOR CONNECTING AN ELONGATED HANDLE TO A BULL FLOAT PLATE

BACKGROUND OF THE INVENTION

This invention relates generally to a concrete finishing tool, more specifically, to a bull float handle attachment device that allows for the pivotable attachment of an elongated handle to a bull float plate which can be rotated by the user to tilt the bull float plate on one edge or to change the pitch of the plate during its usage and application.

Bull floats are used in the construction industry by laborers and concrete finishers to smooth and finish slabs or sections of wet concrete. Numerous styles of concrete floats and other tools for finishing concrete have been available for sometime. For example, U.S. Pat. No. 1,952,398 to Tullis discloses a road tool in the nature of a box channel having an elongated handle. U.S. Pat. No. 3,162,881 to Negwer shows a type of adjustable bull float. U.S. Pat. No. 3,090,984 to Dunnigan provides a type of float used to finish plaster applied overhead. U.S. Pat. No. 3,082,460 to Haivala provides a concrete working tool having a channel member and an elongated handle connected thereto.

U.S. Pat. No. 4,397,581 to Jarvis provides an improvement to a bull float assembly having a groover connectable with the bull float. U.S. Pat. No. 5,115,536 also to Jarvis, provides the improvement in a bull float comprising an adjustable handle mounting bracket which allows adjustment of the handle in various angles relative to the plate portion of the bull float assembly.

The prior art bull float assemblies have various drawbacks. For example, when finishing or smoothing a broad expanse of wet concrete, it may be desirable to have one or more laborers or concrete finishers on each side of the poured slab. One laborer can work the float across the concrete surface and then pass the long handle across to his counterpart so the other laborer can work the float across the other half of the wet slab. Unless the handle is pivotable, the flat surface of the float must be tilted putting one edge on the concrete surface thereby cause damage to the previously finished surface and require more time and labor to complete the job.

There are times, however, in finishing concrete, that it may be desirable to tilt the plate portion of the bull float on edge and draw the edge of the plate, rather than the entire flat surface of the float, across the wet concrete to impart a different texture or finish to the concrete. Using the edge also facilitates the finishing process at an extreme end or border of a poured slab. With most prior art bull float assemblies, it is necessary to apply downward pressure on the handle, using the handle as a lever, to tilt the float plate on edge so as to lift the flat surface of the plate off the wet concrete. This maneuver imparts unwanted downward pressure on the edge of the float plate resulting in a groove or crease in the wet concrete that must be repaired.

Furthermore, it is often desirable to change the angle of the bull float plate relative to the handle (e.g. the "pitch") so that the laborer can finish a slab that is not flat. With many conventional bull float assemblies, the laborer must either lift the handle to impart the proper pitch or bend down and lower the handle to the bull float. It is desirable, therefore, to have a bull float apparatus wherein the pitch of the bull float plate can be varied while the relative angle of the handle to the float remains the same so that the laborer can maintain a convenient hip and foot level without bending or lifting.

Some prior art bull float assemblies employ a pair of opposed chains wrapped helically around the lower end of the elongated handle and around the neck of the handle mounting bracket so that a rotational force of the handle imparts a pivotal force on the float plate so that twisting the handle will raise the float plate up on an edge and change the pitch without changing the angle of the handle to the float. Limited rotation in an opposite direction allows the float to return to a flat position. One such bull float assembly is known as the Hustler® by Goldblatt®.

The above described device that allows for the tilting of the float by applying torque to the handle employing the helical chain arrangement has obvious drawbacks. The exposed chains allow the accumulation of wet concrete in the chainlinks which may interfere with its function and is very difficult to clean. Furthermore, the chains prevent complete pivoting of the handle relative to the float plate so that the handle cannot be pivoted from one side of the plate to the other side of the plate and is thus inconvenient to use on a broad expansive wet concrete in the manner previously described.

SUMMARY OF THE INVENTION

A principal object of the present invention is to provide an apparatus for connecting an elongated handle to a bull float that allows the tilting of the float plate to change pitch by rotating the handle.

Another object of the present invention is to provide a device for connecting an elongated handle to a bull float plate in which the means for translating the torque on the handle to a tilting force on the float plate is a bevel gear assembly.

Still a further object of the invention is to provide a device for connecting an elongated handle to a bull float plate in which the bevel gear assembly is housed in a protective body.

Yet another object of the present invention is to provide a device for connecting an elongated handle to a bull float plate which allows for the pivoting of the handle to each side of the plate in an arc of at least 180°.

Still another object of the present invention is to provide a device for connecting an elongated handle to a bull float plate wherein the handle can be tightly secured at any angle relative to the float.

Another object of the present invention is to provide a device for attaching an elongated handle to a bull float plate that will accommodate a handle of varying lengths.

A still further object of the present invention is to provide a device for connecting an elongated handle to a bull float plate which is economical to manufacture, light in weight, durable, applicable to any length of bull float plate, and is well suited for its intended purpose.

Briefly stated, a device for connecting an elongated handle to a bull float plate having a body, a bracket means pivotably connected to the body for removably attaching the body to a bull float plate, a rotatable connector means to removably connect one end of the elongated handle to the body attached to the body on a side opposite the bull float plate, and a bevel gear assembly housed within the body, cooperatively connecting the handle connector means to the bracket means disposed to translate the rotational movement of the handle connector means into a pivotal movement of the bracket means thereby effecting the pivotal movement of the float plate to change the pitch of the plate.

DESCRIPTION OF THE PREFERRED EMBODIMENT

Figure 1:
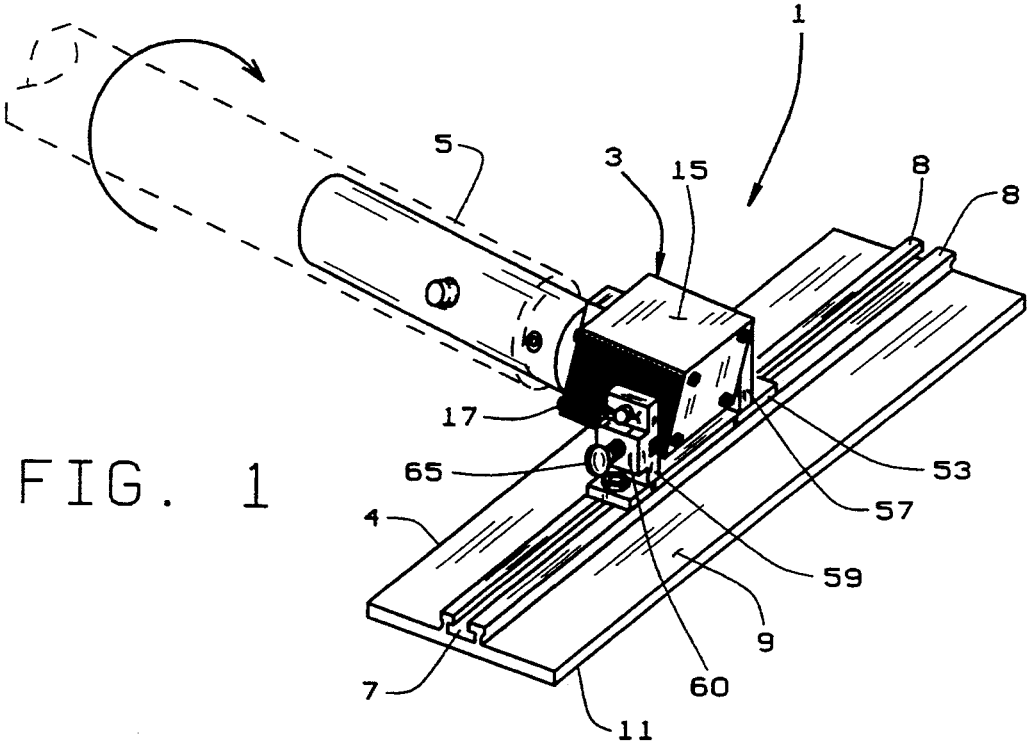
FIG. 1 is an isometric view of the bull float and its functional mechanism disclosing how the handle, shown in phantom line, can be pivoted to vary the pitch of its plate.
Figure 2:
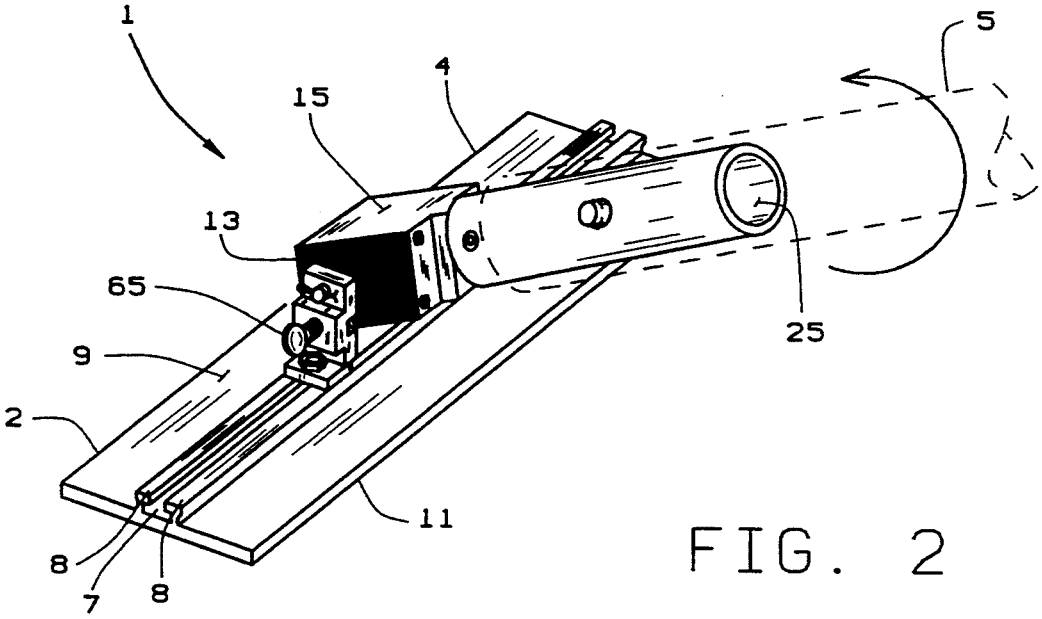
FIG. 2 provides an isometric view, from an opposite angle, showing how the handle can be pivoted in an opposite direction, and provide a variation in the pitch of its plate.

Referring to the drawings, and in particular referring to FIGS. 1 and 2, a bull float assembly 1 is shown, having the connecting device of the present invention shown generally at 3 mounted thereon to pivotably attach an elongated handle 5, shown in phantom, to the assembly. It should be noted that the elongated handle may have a length of a few feet up to as many as ten to fifteen feet. In addition, if additional sections of handle lengths are required, additional segments of the handle may be engaged together, in a manner as known in the art, to supplement the length of the handle, and determine the distance the worker may locate from the bull float during its manipulation. As illustrated in FIGS. 1 and 2, the connector device 3 of the present invention allows pivoting of handle 5 to either side of bull float assembly 1, for a full 180° pivot, so that the bull float can be manipulated from either side.

Bull float assembly 1 has a generally elongated plate 4, having a generally planar top surface 6 and generally flat bottom surface 11. Top surface 6 has two opposed, raised right-angle integral members 8 located centrally on surface 6 and extending horizontally the entire length thereof forming a generally inverted T-shaped channel 7 between members 8 to slidingly accept the connector device as will be explained below. Plate 4, as stated above, has a generally flat bottom surface 11 (FIGS. 6, 7) for contacting and smoothly finishing a surface of wet concrete. Although plate 4 is shown in the illustrations as generally flat, plate 4 can be formed slightly convexed so as to prevent the development of any vacuum or suction when bottom surface 11 is gliding over wet concrete. It should be noted that plate 2 can be formed of any useful configuration, without departing from the scope of this invention. For example, the bull float plate could have front or back raised edges or the lower surface could have a groover formed therein. The novelty of the present invention lies in the unique connecting device 3 that may be used with any number of designs of bull float plates without departing from the scope of the invention.

Figure 3:
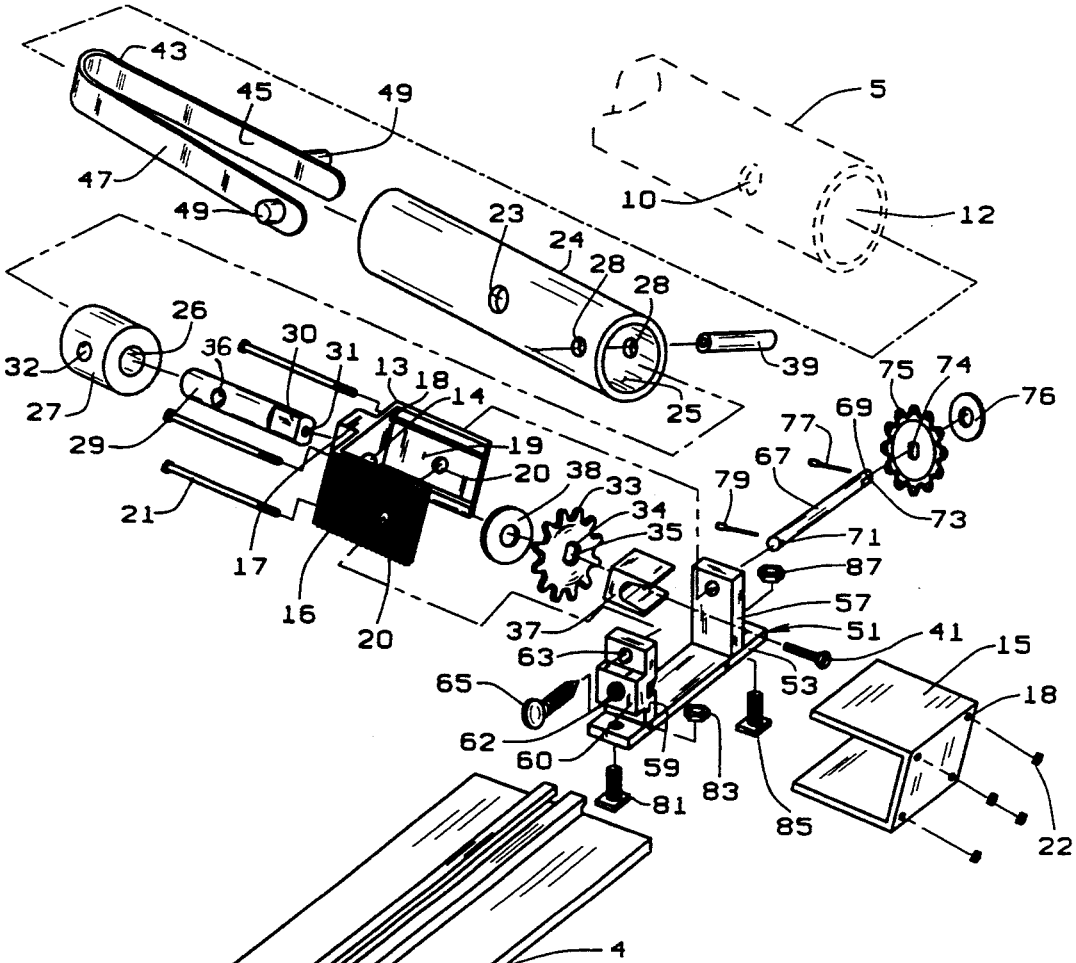
FIG. 3 provides an exploded view of the bull float mechanically actuated connected device.
Figure 4:
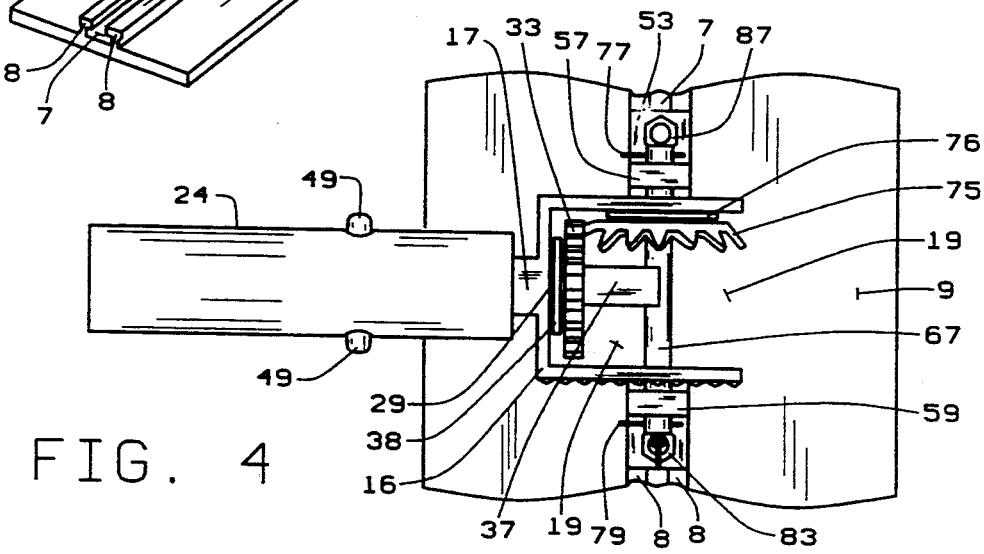
FIG. 4 is a top view of the connecting device and operating gears of the bull float assembly, with its shroud removed.
Figure 5:
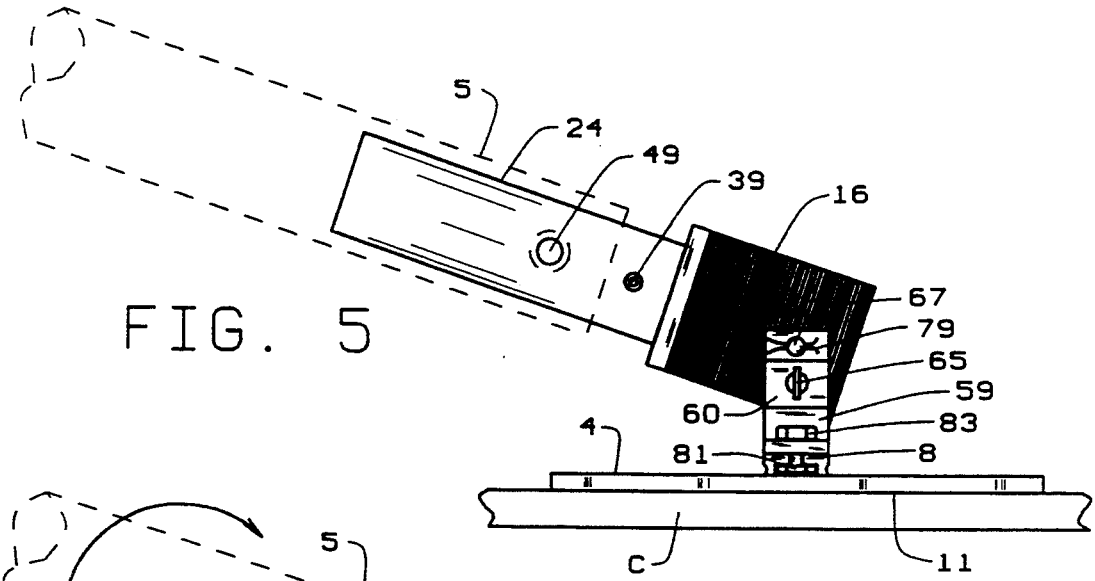
FIG. 5 is a right side view of the bull float as shown in FIG. 1.
Figure 6:
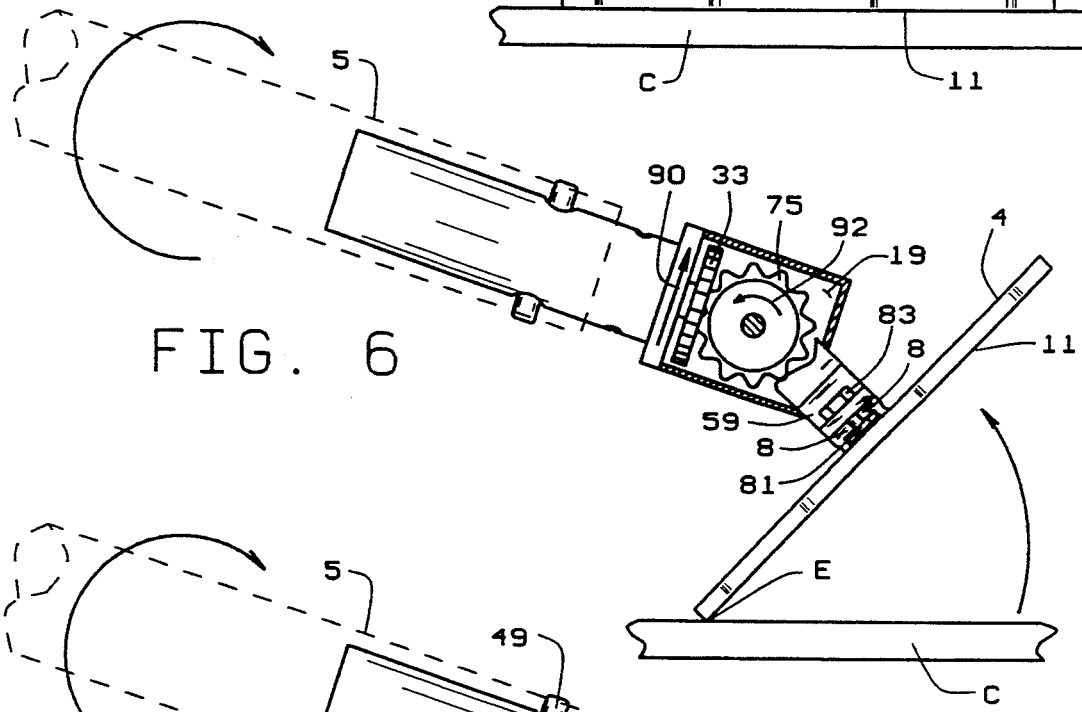
FIG. 6 is a right side view, with the shroud removed, showing how turning of the handle can cause the plate of the bull float to tilt, to its fullest extent.

The various operating components of the connector device 3 of the present invention are best illustrated in FIGS. 3 to 5. Device 3 is comprised of a generally squared C-shaped housing 13 having a removable complimentary generally squared C-shaped shroud 15. One side of housing 13 has a plurality of grooves 16 formed therein to accommodate the nip of a set screw 65 as will be explained below. When assembled, housing 13 and complimentary shroud 15 define an interior space 19 (FIG. 6). Housing 13 has pivot rod holes 20 formed in each opposed wall. Various fastening bolts 21 and complimentary nuts extend through holes 18 in housing 13 and shroud 15 to secure shroud 15 to housing 13. Housing 13 and shroud 15 can be made of magnesium, aluminum or a magnesium/aluminum alloy or any other appropriate lightweight but durable material. It should be noted that any securing means may be used in place of the nut and bolt assembly, but, preferably a securing means should be used that allows the disassembly of the housing and shroud so as to allow access to space 19 and the components therein for maintenance or repair.

Two separate attachment means are operatively connected to housing 13, one such handle connector means is provided to pivotably attach an elongated handle to the housing and the other bracket means is provided to attach a bull float to the housing and thereby connect the bull float to the elongated handle as will now be described.

The handle connector means is comprised of a hollow sheath 24 defining a longitudinal bore 25. Bushing 27 and dowel 29 are located within one end of horizontal bore 25. Dowel 29 having flats 30 and threaded hole 31 on one end thereof seats in bore 26 of bushing 27 with hole 36 aligning with opposed holes 32 and extends through opening 14 formed in boss 17 on the upper surface of housing 13, through spacer 38 through opening 34 with flats 35 formed thereon in gear 33. Dowel 29 is attached to generally C-shaped pivot member 37 by threaded screw 41 which engages threaded hole 31 or by other appropriate attachment means. It should be noted that if a screw assembly is used to attach pivot member 37 to dowel 29, the screw or other attachment means should enter a hole (not shown) in pivot member 37 and be recessed therein so as to not interfere with the pivotal movement of member 37.

Sheath 25, as well as bushing 27, are secured to dowel 29 and thus to housing 13 by pin pivot 39 which extends through holes 28, 20, 32 and 36 of sheath 24, housing 13, bushing 27 and dowel 29 respectively. A handle locking means 43 formed from an essentially V-shaped piece of spring steel or similar material having arms 45 and 47 biased apart, is inserted into bore 25 so that rounded buttons 49 which can be integral with or attached to the ends of arms 45 and 47 are biased outward through opposed holes 23 in sheath 25. A handle, as shown at 5, having a pair of opposed holes 10 and an internal bore 25 formed therein is sized to accept sheath 24 into bore 25. When handle 5 is slid down over sheath 24, buttons 49 are compressed against the bias force exerted by arms 45 and 47 and are pressed into holes 23 to allow downward movement of handle 5 over the sheath. Holes 10 are positioned over buttons 49 so the buttons are biased outward through holes 10 to secure handle 5 in position. Likewise, to remove handle 5, the user depresses buttons 49 forcing them out of holes 10 until handle 5 is released for removal. The various components of the handle connector means just described, can be fashioned from magnesium, aluminum, or a magnesium/aluminum alloy, or any other light weight, durable material unless otherwise noted.

The bracket means for attaching the bull float plate to the housing is best illustrated in FIGS. 3 to 7. Bracket 51 has a generally flat base portion 53 with holes 55 formed therein and two opposed bracket arms 57 and 59 at right angles to lower portion 53. Bracket arm 59 has a hole 63 formed therein and bracket arm 57 has a flattened hole 61 at the upper end therethrough. Bracket arm 59 has a boss 60 with threaded hole 62 formed therethrough to accept threaded set screw 65. Pivot rod 67, with flats 69 at one end, engages flattened hole 74 in bevel gear 75 and extends through spacer 76 so that flats 69 engage flattened hole 61 in bracket arm 57. The opposite end of pivot rod 67 extends through hole 63 in bracket arm 59. Cotter pins 77 and 79 extend through holes 71 and 73 in each end of rod 67 to prevent lateral movement and to keep the assembly in place. As illustrated in FIG. 3, gear 33 engages gear 75 within space 19 in a conventional bevel gear arrangement with a one-to-one gear ratio.

A square headed bolt 81 with associated nut 83 extends up through hole 52 in bottom bracket 53 and square headed bolt 85 with associated nut 85 extends up through hole 56 in the opposite end of lower bracket section 53. The heads of square head bolts 81 and 85 are designed to slidingly engage channel 7 in plate 4 so that nuts 83 and 87 can be tightened drawing bolts 81 and 85 tight against right angle members 8 to secure the bracket assembly to plate 4. It should be noted, that in instances where plate 4 is exceptionally long, more than one device 3 can be employed in the channel 7 so, for example, two handle assemblies can be mounted on one long bull float plate. Moreover, the unique design allows the connector to be positioned at any appropriate position on the bull float plate. The various components of the bracket means, unless otherwise designated, can be made from magnesium, aluminum, magnesium-/aluminum alloy or any other appropriate light-weight, durable material.

Figure 7:
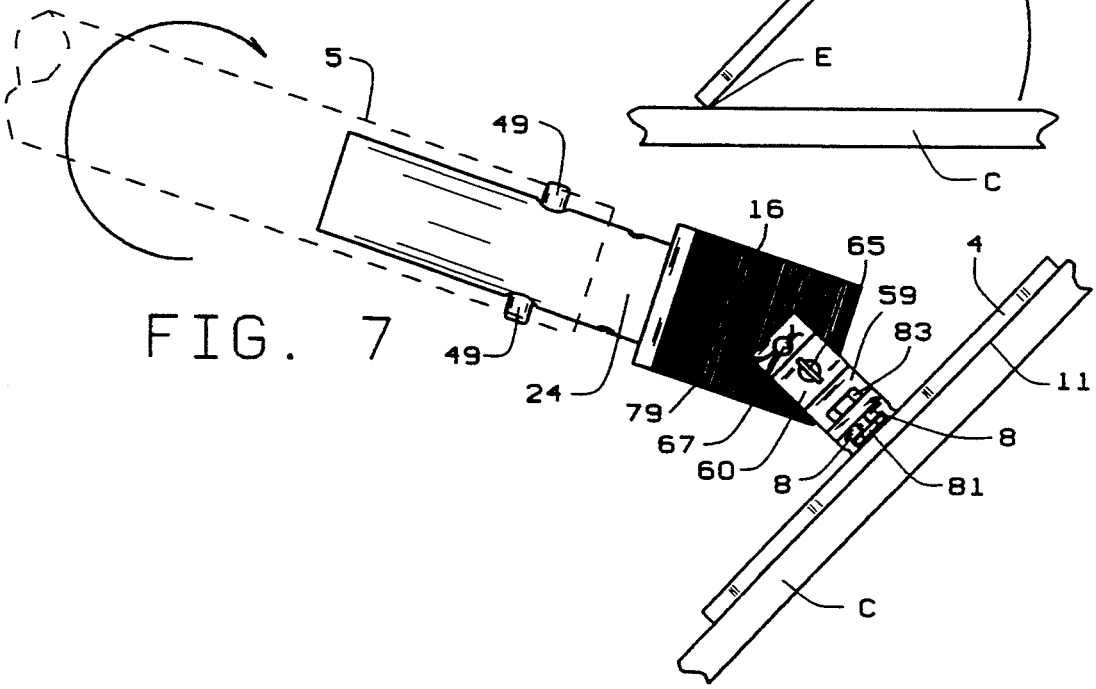
FIG. 7 provides a view of the bull float as applied flush to the concrete surface during its usage and application for functioning as means for smoothing the wet concrete surface.

FIGS. 5 to 7 illustrate the relationship of the above described elements of the unique handle connector device in use. FIG. 4 illustrates plate 4 engaging a flat surface of wet concrete shown generally at C. Often, the laborer wishes to change the pitch of plate 4 as he works it across concrete, for example, to work with the edge as shown in FIGS. 6 or to work on an incline as shown in FIG. 7, without bending or lifting to change the angle of handle 5. With the present invention, rotation of handle 5 by the user causes a rotation of dowel 29. Flats 30 on dowel 29 engage the flats 35 in opening 34 in gear 33, and gear 33 thus rotates as shown by arrow 90. Gear 33 engages gear 75 causing gear 75 to turn in the direction of arrow 92. Flattened opening 74 of gear 75 engages the flat of rod 67 and flat 69 of rod 67 engages the flattened hole 61 in bracket arm 57, and the rotational movement of gear 75 is imparted to rod 67 and thus to the bracket 51 through arm 67 thereby pivoting bracket 51 as well as the attached plate 4, as shown to its fullest extent in FIGS. 6 and 7. Any degree of pivot, even so slight, can be attained. The user can stand back from the bull float, and, with a simple rotation of the handle, tip the bull float plate on an edge as shown as E or change the pitch as shown in FIG. 7 without having to change the angle of the handle relative to the plate. This allows the user to maintain the handle in a comfortable and constant working position.

Referring again to FIGS. 1 and 2, handle 5 can be pivoted at least 180° from one side of plate 4 to the other. Pivot member 37 and housing 13, with handle 5 pivotally attached as previously described on pivot rod 67. While rod 67 remains stationary with flats 69 secure in flatten hole 61 in bracket arm 57.

To lock the assembly in a position with handle 5 in one desired angle relative to plate 4, set screw 65 can be tightened until it engages an appropriate groove 16 on the side of housing 13 thereby releaseably locking the housing 13 and bracket 51 in place in any chosen angular relationship.

Variations or modifications to the subject matter of this invention may occur to those skilled in the art upon reviewing the subject matter of this disclosure. Such variations or modifications, if within the spirit of this invention, are intended to be encompassed within the scope of any claims to patent protection issuing upon this development. The description of the preferred embodiment set forth herein and as depicted in the drawings, are provided for illustrative purposes only.

Having thus described the invention, what is claimed and desired to be secured by Letters Patent is:

1. In an adjustable concrete finishing tool for use in finishing concrete or the like having a plate portion with a handle removably attached thereto, the plate portion having a bottom side for finishing concrete and an upper side for the attachment of the handle thereto, means for attaching the handle to the plate comprising:

a housing having a top wall and opposed side walls and a complementary, removable Shroud having a bottom wall, two opposed side walls, all of said walls when the housing is assembled defining an interior chamber;

a handle connector means for removably securing one end of said handle to said housing and capable of rotation with respect to said top wall and said housing;

a bracket means pivotally attached to said side walls of said housing and disposed to removably attach the plate portion to said housing opposite said handle connector means; and, a gear means within said interior chamber connecting said handle connector means to said bracket means, said gear means capable of translating rotational movement of said handle attachment means into pivotal movement of said bracket means and thereby to said plate portion.

2. The invention of claim 1, wherein said bracket means further comprises a securing means for releasably securing said handle connector means in an angular position relative to said plate portion.

3. The invention of claim 1 wherein said connector means and its attached handle are capable of pivoting of the handle in an arc of at least 180° with respect to the plate portion and its attached bracket means.

4. The invention of claim 1 wherein said gear means comprises a bevel gear assembly.

5. The invention of claim 2 wherein said securing means comprising a threaded locking means provided on said bracket means and releasably engaging said housing to lock the handle and the handle connector means in position with the plate portion of the bull float once its angular position is adjusted.

6. The invention of claim 1 wherein said tool is made from a light-weight metal selected from a group consisting of aluminum, magnesium, and aluminum/magnesium alloy.

* * * * *